US005819499A

United States Patent [19]

Evason et al.

[11] Patent Number: 5,819,499

[45] Date of Patent: Oct. 13, 1998

[54] INSULATING UNITS

[76] Inventors: John Evason, 15 Glencoyne Drive, Southport, Merseyside PR9 8TS; Mervyn John Davies, Flat 5, Oxford Court, Trafalgar Road, Southport, Merseyside PR8 2EA; Kenneth John Pearson, 2 St James Road, Rainhill, St Helens, Merseyside L35 OFF, all of United Kingdom

[21] Appl. No.: 570,346

[22] Filed: Dec. 11, 1995

Related U.S. Application Data

[63] Continuation of Ser. No. 111,955, Aug. 26, 1993, abandoned.

[30] Foreign Application Priority Data

Aug. 26, 1992 [GB] United Kingdom ..... 9218150

[51] Int. Cl.[6] ..... E04C 2/54

[52] U.S. Cl. ..... 52/788; 52/790

[58] Field of Search ..... 49/DIG. 1; 52/171, 52/172, 785, 788, 790, 726

[56] References Cited

U.S. PATENT DOCUMENTS

| | | |
|---|---|---|
| 3,105,274 | 10/1963 | Armstrong . |
| 3,865,144 | 2/1975 | Westhoff . |
| 3,876,489 | 4/1975 | Chenel . |
| 3,897,580 | 7/1975 | Ingemansson et al. . |
| 4,057,945 | 11/1977 | Kessler . |
| 4,080,482 | 3/1978 | Lacombe . |

(List continued on next page.)

FOREIGN PATENT DOCUMENTS

| | | |
|---|---|---|
| 0054251 | 6/1982 | European Pat. Off. . |
| 0065150 | 11/1982 | European Pat. Off. . |
| 0139262 | 12/1987 | European Pat. Off. . |
| 0397981 | 11/1990 | European Pat. Off. . |
| 2424225 | 12/1974 | Germany . |

(List continued on next page.)

OTHER PUBLICATIONS

Abstract of UK 1,485,151, Jan. 1975.
Abstract of UK 1,496,540, Mar. 1975.
Abstract of UK 1,510,208, Dec. 1975.
Abstract of UK 1,508,778, Jun. 1975.
Abstract of EP 506,522, Mar. 1992.
Abstract of EP 491,365, Dec. 1991.
Abstract of EP 3715, Jan. 1979.

(List continued on next page.)

*Primary Examiner*—Lanna Mai
*Attorney, Agent, or Firm*—Burns, Doane, Swecker & Mathis

[57] ABSTRACT

A sealed insulating unit including two parallel opposed panes with a spacing and sealing system therebetween defining, with said panes, a sealed gas spaced between them, said spacing and sealing system comprising a spacer frame with a primary seal between each side of the spacer frame and the opposing pane face and a secondary seal extending between the panes outside the outer peripheral face of the spacer frame characterised in that each primary seal is greater than 0.4 mm thick on construction of the unit and comprises at least 7 grams of sealant material on each side of the spacer frame per metre of the spacer frame length. There is also provided a method of producing a sealed insulating unit including the steps of providing a spacer frame of required size, applying primary sealant to each side face of the spacer frame, assembling the spacer frame with and between two opposed parallel panes so that the spacer frame with the panes defines a gas space therebetween, and, with a primary seal thickness of greater than 0.4 mm on each side of the spacer frame, applying a secondary sealant into a channel between the panes outside the outer peripheral face of the spacer frame and curing said secondary sealant in situ between the panes. There is further provided a spacer for a sealed insulating unit in which in the side walls of the spacer are defined elongate recesses, the dimensions of the recesses being selected such that sufficient primary sealant can be accomodated therein to provide in the sealed insulating unit opposed primary seals each at least 0.4 mm thick.

14 Claims, 3 Drawing Sheets

U.S. PATENT DOCUMENTS

| | | |
|---|---|---|
| 4,171,601 | 10/1979 | Gotz . |
| 4,222,213 | 9/1980 | Kessler . |
| 4,296,587 | 10/1981 | Berdan . |
| 4,322,926 | 4/1982 | Wölflingseder et al. . |
| 4,324,071 | 4/1982 | Ishida . |
| 4,334,941 | 6/1982 | Neely, Jr. . |
| 4,551,364 | 11/1985 | Davies . |
| 4,552,790 | 11/1985 | Francis . |
| 4,564,540 | 1/1986 | Davies et al. . |
| 4,719,728 | 1/1988 | Eriksson et al. . |
| 4,720,950 | 1/1988 | Bayer et al. . |
| 4,817,354 | 4/1989 | Bayer . |
| 4,850,168 | 7/1989 | Thorn . |
| 4,850,175 | 7/1989 | Berdan . |
| 4,890,438 | 1/1990 | Tosa et al. . |
| 4,893,443 | 1/1990 | Haber . |
| 4,893,902 | 1/1990 | Baughman et al. . |
| 4,994,309 | 2/1991 | Reichert et al. . |
| 5,088,258 | 2/1992 | Schield et al. . |
| 5,125,195 | 6/1992 | Brede . |
| 5,128,181 | 7/1992 | Kunert . |

FOREIGN PATENT DOCUMENTS

| | | |
|---|---|---|
| 2744880 | 4/1978 | Germany . |
| 2929544C2 | 6/1982 | Germany . |
| 1419875 | 12/1975 | United Kingdom . |
| 1477576 | 6/1977 | United Kingdom . |
| 1515312 | 6/1978 | United Kingdom . |
| 2007750 | 5/1979 | United Kingdom . |
| 2064631 | 6/1981 | United Kingdom . |
| 2077833 | 12/1981 | United Kingdom . |
| 2077834 | 12/1981 | United Kingdom . |
| 2078129 | 1/1982 | United Kingdom . |
| 2083120 | 3/1982 | United Kingdom . |
| 2213859 | 8/1989 | United Kingdom . |
| 2227274 | 7/1990 | United Kingdom . |
| WO93/20320 | 10/1993 | WIPO . |

OTHER PUBLICATIONS

Abstract of FR 2,268,146, Apr. 1974.

Abstract of FR 2,265,964, Mar. 1975.

Advertisement "Vitroform", Fr. Xaver Bayer, Hamburg, Germany.

INSULATING UNITS

This application is a continuation of application Ser. No. 08/111,955, filed Aug. 26, 1993 now abandoned.

BACKGROUND TO THE INVENTION

The present invention relates to sealed insulating units, especially but not exclusively sealed double glazing units, and, in particular, to a form of construction of sealed insulating units which provides an assured long lifetime, to a method of constructing sealed insulating units to achieve an assured long lifetime, and to the use of a thick primary seal to achieve such a lifetime. The present invention also relates to spacer frame constructions for such units.

In a well known form of construction, a sealed double glazing unit comprises two parallel opposed panes of transparent or translucent glazing material, usually but not necessarily glass, with a spacing and sealing system therebetween defining, with the panes, a sealed gas space. The space usually contains air, but selected other gases may be used in place of air to enhance the thermal or acoustic insulating properties of the unit. The spacing and sealing system may comprise a spacer frame, commonly lengths of hollow section spacer, for example of aluminum alloy or plastics, joined by right angled corner keys to form a rectangular frame (or a single length of such hollow section spacer bent to form a rectangular with the free ends joined by a key), a primary seal and a secondary seal. The primary seal is composed of a non setting extrudable thermoplastic material with good adhesion to the spacer frame and panes, an a low moisture vapour transmission, such as polyisobutylene, incorporated between the side walls of the spacer frame and the opposing faces of the panes. The primary seal serves to prevent ingress of moisture vapour between the spacer frame and the panes, and may also assists in the assembly of the unit by securing the spacer frame in position between the panes while the secondary sealant is applied end cured. The secondary sealant is usually a two component material which is initially extruded into a channel defined by the outer peripheral face of the spacer frame and the adjacent faces of the opposing panes, but cures in situ to bond the panes and spacer frame together. The secondary sealant, which is typically of polysulphide, polyurethane or silicone, commonly has good adhesive properties and forms a strong bond to both spacer frame and glass; however, the moisture vapour transmissions of the materials used are generally significantly higher than those of the primary sealants. Thus the gas space of the unit may be better protected from moisture ingress (and consequent condensation on the interior surfaces of the panes defining the gas space) by the use of the additional primary seals as described above between the spacer and the panes.

This form of construction is widely used and gives good results. A drying agent, usually of the kind described as a molecular sieve, may be incorporated within the body of the hollow section spacer constituting the spacer frame and be in communication with the gas space between the panes through orifices in the inner peripheral wall of the spacer. This drying agent absorbs any moisture initially present in the gas in the sealed space between the panes, and is also available to absorb further moisture penetrating through or past the primary and secondary seals. Eventually however, the drying agents become saturated and unable to absorb further moisture so that the moisture content of the gas between the panes increases and water vapour condenses on an internal pane surface; such condensation detracts from ,he appearance of the unit generally being regarded as amounting to failure of the unit and requiring replacement of the unit.

Typical good quality units have a lifetime of at least 10 years to failure, and many are guaranteed for five or even ten years. There is demand for units with a longer lifetime, but manufacturers are reluctant to offer guarantees as they have bee unable to produce units which provide consistently longer lifetimes.

Hitherto, premature failures have generally been associated with poor unit construction, for example, insufficient or poorly mixed secondary sealant, or insufficiently cleaned pines resulting in poor adhesion to the glass, and attempts to provide more reliable and consistent unit Lifetimes have generally concentrated on avoiding such construction deficiences.

SUMMARY OF THE INVENTION

The present inventors have found, however, and the discovery forms the basis of the present invention, that a consistently long unit lifetime may be achieved for "twin seal" units of the kind described above by using a thicker primary seal than generally used hitherto or recommended by suppliers of the primary sealant material. Thus, for example, one typical sealant supplier recommends the use of 2.5 grams of primary sealant (on each side of the spacer) per meter of spacer frame length, and that the applied primary sealant strip should be compressed to a thickness of between 0.3 and 0.4 mm on assembly of the unit, the corresponding depth of the sealant strip being 4.5 mm. In practice, unit manufactured tend to use less of the primary sealant material to save cost. Moreover, since the only path for ingress of moisture vapour into the gas space of the unit is between the sides of the spacer and the opposing pane surfaces it has been considered chat a wider gap (corresponding to the thickness of the primary sealant) would lead to greater moisture ingress. The inventors have discovered, however, that the use of a sealant thickness greater than 0.4 mm, preferably at least 0.5 mm, enables a consistently longer unit life to be achieved before the dew point is reached and the unit fails, with a much lower risk of premature failure.

Although, as noted above, it has been usual to use a primary seal thickness of less them 0.4 mm, it has been proposed to use a spacer with pre-applied primary sealant on each side to form the spacer frame to avoid the need for applying the primary seal on tie double gluing production line, for example the VITROFORM (trade mark) insulated glass profile system. This included a spacer with recesses on the side walls thereof to facilitate pre-application of the primary seal material extending into the recesses: the spacer was designed to be bent in one process into a closed rectangular spacer frame avoiding the need for corner keys as described above, and the width of the primary sealant layer on the sides of the spacer was of the order of 1 mm or more before compression between panes. The thick primary seal, which incorporated a core of circular section of about 1 mm diameter, was used to provide thermal separation between the spacer and the glass unit with "surface damping" for improved sound insulation, but there was no suggestion that its use provided an extended unit lifetime. We have measured the amount of sealant material applied to the sidewalls of the VITROFORM spacer, and found an amount of 6.1 grams (excluding the core) on each side of the spacer per meter of spacer length.

Reverting to the present invention, it will be appreciated that the use of a wider seal than is normal, for a constant seal depth, implies the use of a greater amount or seal material, and in a preferred embodiment of the present invention at lease 7 grams of sealant material is used on each side of the spacer frame per meter of spacer length.

According to the present invention, there is provided a sealed insulating unit comprising two parallel opposed panes with a spacing and sealing system therebetween defining, with said panes, a sealed gas space between them, said spacing and sealing system comprising a spacer frame with a primary seal between each side of the spacer frame and the opposing pane face and a secondary seal extending between the panes outside the outer peripheral face of the spacer frame characterised in that each primary seal is greater than 0.4 mm thick on construction of the unit and comprises at least 7 grams of sealant material on each side of the spacer per meter of spacer frame length.

According to a second aspect of the invention, there is provided a method of producing a sealed insulating unit comprising providing a spacer frame of required size, applying primary sealant to each side face of the spacer frame, assembling the spacer frame with and between two opposed parallel panes so that the spacer frame with the panes defines a gas space therebetween and, with a primary seal thickness of greater then 0.4 mm, preferably greater than 0.5 mm, on each side of the spacer frame, applying a secondary sealant into a channel between the panes outside the outer peripheral face of the spacer frame and curing said secondary sealant in situ between the panes. The primary sealant will usually, but not necessarily, be used in an amount of at least 4 grams of sealant material on each side of the spacer frame per meter of spacer frame length.

According to a third aspect of the invention, there is provided the use, in a twin seal sealed insulating unit, of a primary seal between each side of a spacer frame and the adjacent opposing pane having a thickness of greater than 0.4 mm on construction of the unit, to extend the reliable lifetime of the unit. In these second and third aspects of the invention, the account of primary seal material is preferably, but not necessarily, at least 7 grams on each side of the spacer frame per meter of spacer length.

In each aspect of the invention, each primary seal preferably has a thickness of up to 1 mm on construction of the unit. Each primary seal preferably comprises 7 to 12 grams, especially 3 to 11 grams, of primary sealant material (more may be used but is not cost effective) on each side of the spacer frame per meter of spacer frame length. The opposite sides of the spacer frame facing the panes may be provided with recesses to accommodate at least part of the primary seal material, and ensure that a desired minimum thickness of primary seal material is retained in position when the unit is assembled.

According to a fourth aspect of the invention, there is provided a spacer for a sealed insulating unit comprising two parallel opposed panes with a spacing and sealing system therebetween, the spacer comprising an elongate hollow metal member having opposed outer and inner walls connected together by two opposed side walls, the side walls each defining therein an elongate recess, the dimensions of the recess being selected such that sufficient primary sealant can be accomodated therein to provide in the sealed insulating unit opposed primary seals each at least 0.4 mm thick.

In one preferred embodiment, the recess has an arcuate section having a centre of curvature located laterally within the outward lateral edge of the respective side wall.

In another preferred embodiment, the recess has a section in the form of a trapezium.

BRIEF DESCRIPTION OF THE DRAWINGS

The invention is illustrated, but not limited, by the following description with reference to the accompanying drawings in which.

DETAILED DESCRIPTION OF THE PREFERRED EMBODIMENTS

Figure 1:
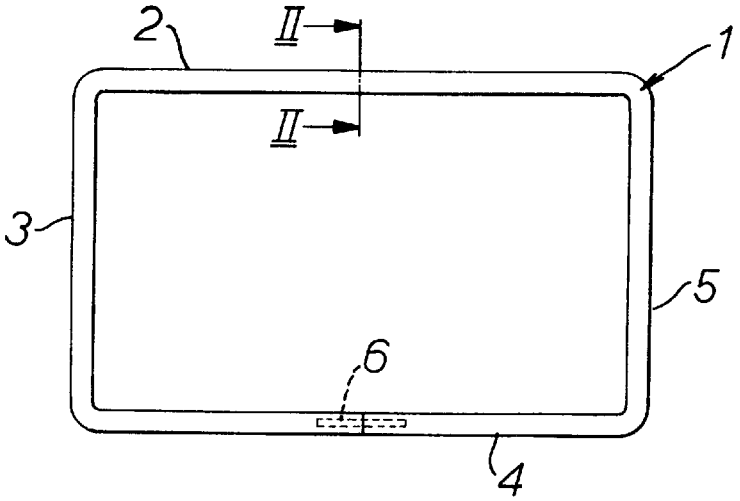
FIG. 1 is a plan view of a spacer frame.
Figure 2:
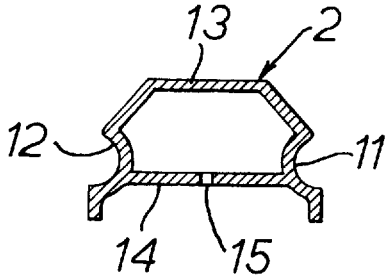
FIG. 2 is a section on the line II—II of FIG. 1.
Figure 3:
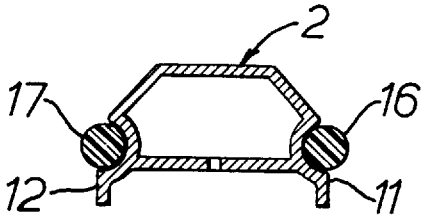
FIG. 3 is a section, corresponding to the section shown in FIG. 2, after application of the primary seal.
Figure 4:
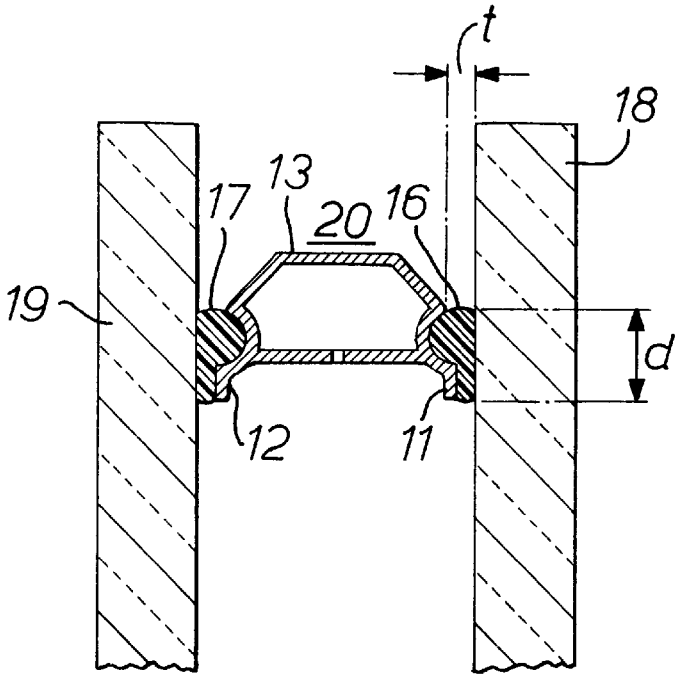
FIG. 4 is a section, corresponding to the section shown in FIGS. 2 and 3, after application of the primary seal material and assembly of the spacer frame with two opposed parallel panes.
Figure 5:
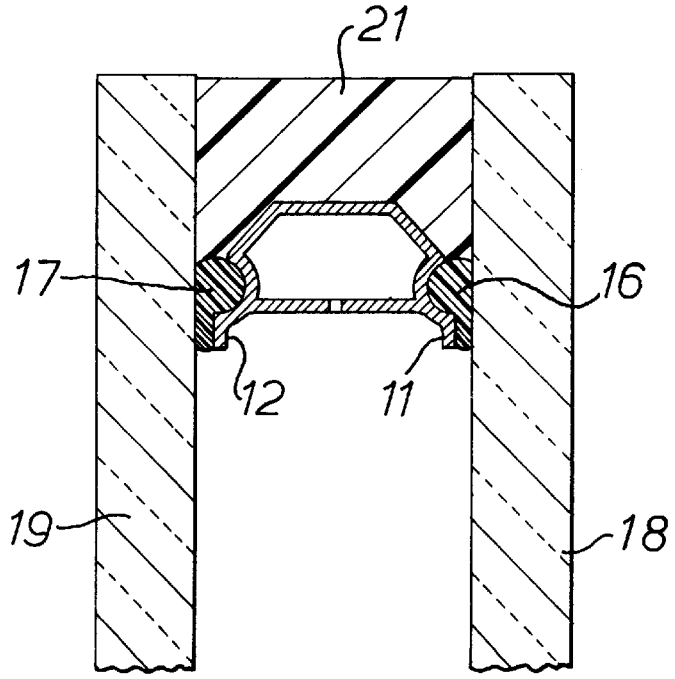
FIG. 5 is a section, corresponding to the section shown in FIGS. 2, 3 and 4, after application of the primary seal, assembly of the spacer frame with two opposed parallel panes, and application of the secondary sealant.

Referring to FIG. 1, a rectangular spacer frame 1 having sides 2, 3, 4 and 5 is produced by bending a hollow section aluminium spacer at right angles into rectangular form with the adjacent free ends joined by a key 6. The section shown in FIG. 2 is typical of each side of the spacer frame and shows side walls 11,12, outer peripheral wall 13 and inner wall 14; holes 15 in the inner wall provide for communication between a drying agent (not shown) which may be incorporated in the cavity of the hollow section spacer and a sealed gas space to be formed between the spacer frame and panes of an assembled insulating unit. FIG. 3 shows a nonsetting thermoplastic material 16,17 extruded on to the opposed side walls 11,12 of the spacer frame to provide a primary seal. The spacer frame, with the primary seal material applied to opposed side walls 11,12 is assembled between two opposed parallel glass panes 18,19 as shown in FIG. 4 to form a primary seal of thickness t, greater than 0.4 mm, and depth d. The primary seal preferably has a thickness greater than 0.4 mm over a depth of at least 3 mm, especially a depth of at least 4 mm. A channel 20 is formed between the outer peripheral face of the spacer frame and the inner opposed faces, outside the spacer frame, and panes 18 and 19. FIG. 5 shows the channel 20 filled with a secondary sealant 21 which may be cured in situ between the panes.

Figure 6:
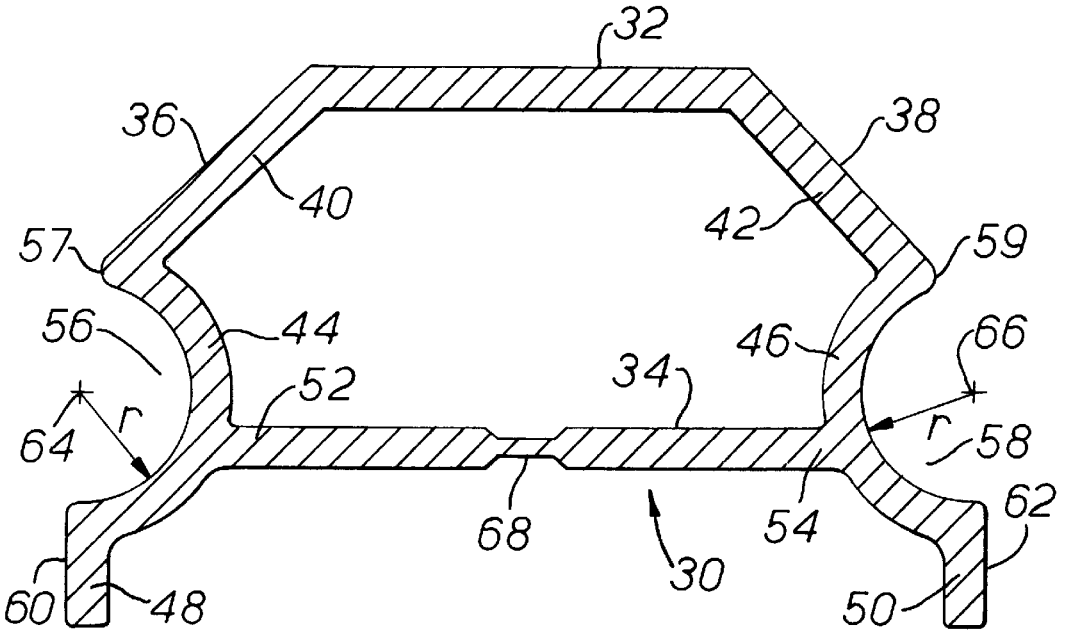
FIG. 6 is a section through a spacer frame in accordance with an embodiment of the invention.

A preferred construction of a spacer frame is shown in FIG. 6 which is a section, similar to FIG. 2, through a spacer 30. The spacer 30 is adapted to be bendable to form a closed loop configuration such as that illustrated in FIG. 1, with the two ends being connected by a key. The spacer 30 shown in FIG. 6 is in its initially unbent form.

The spacer 30 is formed of elongate hollow section aluminium having a flat outer peripheral wall 32 and a flat inner wall 34, which walls 32,34 are connected by opposed side walls 36,38. Each side wall 36,38 comprises an outer inclined part 40,42, an intermediate arcuate part 44,46 and an inner straight part 48,50. The outer wall 32 is laterally shorter than the inner wall 34 and the inclined walls 40,42 each extend inwardly and laterally away from the outer wall 32 to connect with the respective arcuate part 44,46. The opposed ends 52,54 of the inner wall 34 connect to the respective arcuate parts 44,46 at a point slightly towards the relatively inner end of the respective arcuate parts 44,46.

Each arcuate part 44,46 defines a substantially semi-circular section recess 56,58. The outer edge of the junctures 57,59 of the inclined parts 36,38 and the respective arcuate parts 44,46 are recessed laterally inwardly from the laterally outer face 60,62 of the respective straight parts 48,50. The centre of curvature 64,66 of the respective arcuate portions 44,46 are located laterally inwardly of the respective outer faces 60,62 of the straight portions 48,50. A central part of the inner wall 34 is provided with a thinned portion 68 in which are provided a series of holes (not shown) for communication of a dessicant in the hollow cavity with the sealed interspace of the glazing unit.

The radius of each recess 56,58 is preferably about 1.35 mm, the junctures 57,59 are preferably located about 0.65 mm laterally inwardly from the outer faces 60,62, the depth of each straight part is preferably about 1.6 mm and the total width and depth of the spacer are about 12 mm and 7 mm respectively.

When the spacer 30 is bent in the manner described above, in the region of the bend, the inner wall 34 is deformed inwardly, the two inclined walls 36,38 are deformed laterally outwardly whereby the junctures 57,59 become substantially level with the respective outer faces 60,62 of the straight parts 48,50. Thus in the region of the bends, the recesses 56,58 are substantially semi-circular in section with the respective centres of curvature 64,66 lying substantially in a plane defining the lateral edge of each side of the bent spacer 30.

The spacer configuration 30 shown in FIG. 6 provides the advantage that relatively large recesses 56,58 are provided, because they are semi-circular and initially have the centres of curvature thereof lying within the lateral extremeties of the spacer and so are relatively deep for their width. This means that a relatively large body of primary sealant material can initially be present in the recesses 56,58. This assists in ensuring that a minimum thickness of at least 0.4 mm of primary sealant material extends between the spacer 30 and the respective glass surface. In the regions where the spacer has been bent, the recess configuration is substantially symmetrical about a central common plane through the recesses 56,58 and this assists in ensuring a reproducibly thick seal of primary material.

Figure 7:
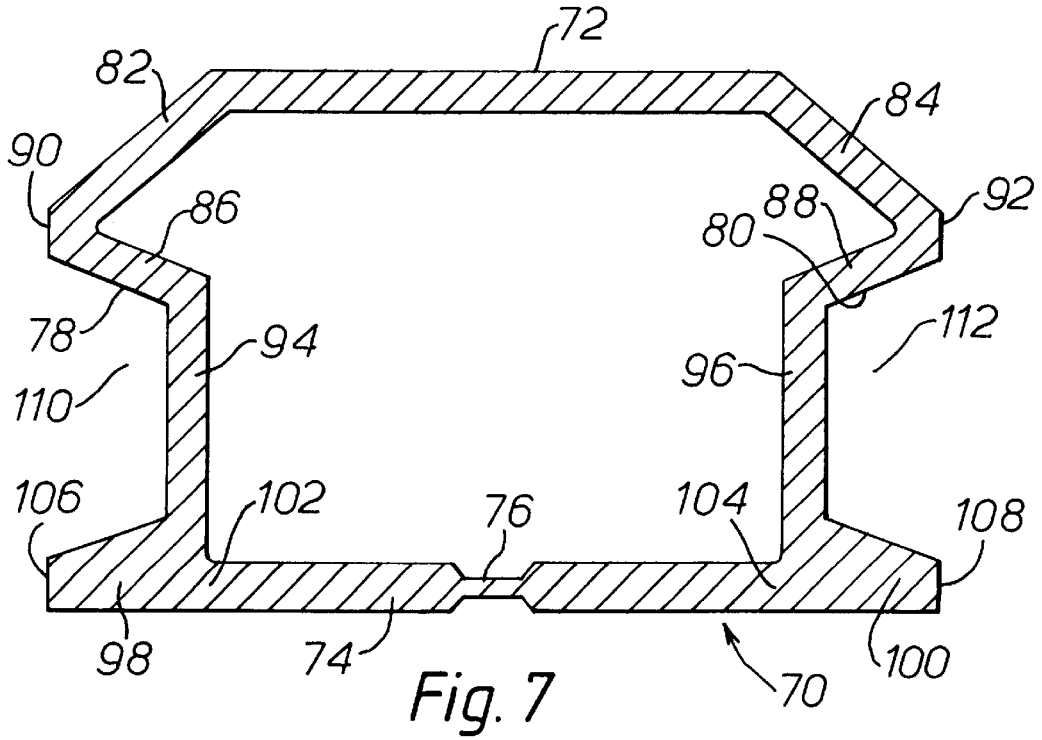
FIG. 7 is a section through a spacer frame in accordance with a further embodiment of the invention.

Referring now to FIG. 7, there is shown an alternative embodiment of a spacer frame in accordance with the invention. The spacer 70 comprises an outer peripheral wall 72 and an inner wall 74 having a thinned portion 76 in a central region thereof through which holes (not shown) may be provided. The outer and inner walls 72,74 are connected by opposed side walls 78,80. Each side wall 78,80 consists, going from the outer peripheral wall 72 to the inner wall 74, of a laterally outwardly inclined part 82,84, a laterally inwardly inclined part 86,88, with there being a respective juncture 90,92 therebetween, a straight part 94,96 and an outward inclined part 98,100 to which respective ends 102,104 of the inner wall are connected. Each inclined part 98,100 has at its laterally outward edge a flat surface 106,108 which is laterally level with the respective juncture 90,92. In an alternative embodiment, the junctures 90,90 are disposed laterally inwardly of the flat surfaces 106,108 to provide gaps through which excess sealant may be hydraulically pumped if required. The inclined parts 86,98 and 88,100 are configured so as to define therebetween, and laterally outwardly of the respective straight parts 94,96, respective recesses 110,112. Each recess 110,112 has a section in the form of a regular trapezium. The inclined parts 86,88 and 98,100 are each inclined at an angle of around 110° to the respective straight part 94,96. Each recess 110,112 is around 1.5 mm wide and 3.8 mm deep.

The spacer 70 shown in FIG. 7 may be formed into a frame by connecting corner pieces, i.e. without being bent but alternatively the spacer 70 may be bent in the manner described hereinabove whilst holding the junctures 90,92 laterally level with the respective faces 106,108. Irrespective of which spacer frame configuration is employed, the spacer 70 is configured so that the recesses 110,112 can contain the desired weight of butyl material prior to pressing. After pressing, as a result of the symmetrical shape of the trapezium section recesses 110,112, any primary sealant which is extruded from the recesses is substantially uniformly extruded both inwardly and outwardly. The symmetrical construction of the recesses provides, during the pressing step, equal hydraulic bending or deforming forces acting on the spacer which tends to prevent bending or bowing of the spacer during the pressing step. Furthermore, the recesses, having a trapezium section, have a relatively deep area where the width of the recess is a maximum amount. This provides a relatively large area over which the primary sealant material is relatively thick in the recess relative to the remainder of the region of the spacer which is in contact with the primary seal. The spacer recess shape assists in ensuring reliable obtaining of a primary sealant thickness of at least 0.4 mm whilst substantially avoiding inadvertent deformation of the spacer during the formation of the double glazing unit.

As is discussed hereinabove, the use of a wider primary seal in accordance with the present invention provides unexpected advantages despite the technical prejudice that existed prior to the present invention against using wide primary seals. Although the primary seal material has good resistance to moisture vapour transmission, it was believed prior to the present invention that the primary seal should be made thin so as to reduce the surface area of the primary seal potentially available for water vapour transmission. However, the present inventors discovered surprisingly that the use of wider primary seals than in the prior art did not lead to increased unit failure compared to the known units as a result of water vapour transmission through the primary seal. In fact, the inventors discovered that by using a thicker seal, the lifetime of the units was increased due to a decrease in water vapour penetration. This is believed to result from a reduced incidence of cohesive failure in the flexible primary seal material as a result of repeated flexing of the unit as a result of pressure/temperature change in the environment to which the unit is subjected. It is believed that the thicker primary seal in accordance with the invention acts to absorb these flexing stresses at the glazing unit edge to a greater degree than the thinner primary seals of the prior art. In addition, the thicker primary seal tends to reduce the absorption of water therein which can lower the elastic modulus of the material which in turn can tend to cause failure of the primary seal.

In particular, when the glazing unit is subjected to an increase in temperature, this can cause an increase in the thickness of the unit at the sealed edge of the unit. This thickness increase results from an expansion of the secondary sealant when it is heated. Typical secondary sealant materials, when heated and subject to stretch, tend to remain stretched to some degree after cooling. The use of a thicker primary seal in accordance with the present invention provides that the primary seal is more likely to accomodate such stretching of the secondary material resulting in a thickness increase of the unit edge without causing a breakdown of the primary seal.

The present invention will now be described in greater detail with reference to the following non-limiting Examples.

EXAMPLE 1

A rectangular spacer frame of external plan dimensions 500 mm×350 mm was made up of a single length of hollow section aluminium alloy spacer 7 mm×10 mm as illustrated in FIG. 2 with the adjacent free ends joined by an aluminium key, and Naftotherm (trade mark) BU polyisobutylene primary seal material extruded on to the opposed side walls 11,12 of the spacer frame (FIG. 3) all around the periphery thereof at a rate of approximately 10 grams per meter of peripheral length of the spacer frame on each side thereof.

Two 6 mm clear, float glass panes each 510 mm×360 mm were washed and dried and assembled with the spaces frame bearing the primary seal material symmetrically disposed between them, and the opposed panes pressed together to an overall unit thickness of 23.4 mm thereby compressing the primary sealant layer to a thickness of 0.7 mm or greater over a depth of 4.5 mm. The resulting channel 20 defined between the outer face 13 of the spacer frame and the internal face of the opposed panes was filled with Dow Corning (trade mark) Q3-3332 two part silicone as secondary sealant and the sealant cured in situ between the panes at room temperature to produce a completed insulating unit. A batch of ten similar units was made up for testing, and subjected to the following weather test.

The units are subjected in a chamber at near 100% relative humidity, to a temperature cycle regime of 35° C. to 75° C. in 4.5 hours followed by cooling from 75° C. to 35° C. in 1.5 hours so each unit experiences 4 cycles per day.

At approximately every 50 cycles, the dew point in every unit is measured. A lone life unit construction may be regarded as one where all 10 units of a batch retain dew points of equal to or less than, −40° C. at 500 cycles. In some cases, unit failure is a result of venting that can occur due to a faulty single unit rather than the particular construction.

In addition, the thickness of 2 units in each batch of 10 is measured at 8 points around the periphery, i.e. at the corners and at the centres of each edge. The purpose of this test was to assess the strain that the primary butyl seal experienced throughout the cycling programme. The results of the weather test are shown in the following table:

| | No of units having dew points | | | | | |
|---|---|---|---|---|---|---|
| No of cycles | <−50° C. | −49° C. to −40° C. | −39° C. to −30° C. | −29° C. to −20° C. | −19° C. to −10° C. | −9° C. to −1° C. |
| 50 | 10 | | | | | |
| 98 | 10 | | | | | |
| 140 | 10 | | | | | |
| 195 | 10 | | | | | |
| 246 | 10 | | | | | |
| 293 | 10 | | | | | |

and all 10 units retained a dew point below −50° C. when testing was continued to over 1000 cycles.

The thickness measurements showed, surprisingly, an increase in the thickness of the units after the first fifty cycles. This increase was greatest (up to about 0.8 mm) at the corners but still significant (about 0.4 to 0.5 mm) at the centres of the edges, and tended to declines as the weathering tests continued. It is believed the invention operates by providing sufficient primary seal material to accommodate the unexpected expanded thickness while maintaining the integrity of the primary seal and its adhesion to the spacer and the glass.

COMPARATIVE EXAMPLE 1

The procedure of Example 1 was repeated except that the spacer used had a section of 7 mm×11.9 mm and the primacy seal material was extruded onto the opposed side walls at a rate of approximately 3.5 grams per meter of peripheral length of the spacer frame on each side thereon. The opposed panes were pressed together to an overall unit-thickness of 24.5 mm—thereby compressing the primary sealant layer to a minimum thickness of 0.3 mm. with a greater thickness where the primary sealant extends into the recess in the spacer. A batch of ten similar units was made up for testing and subject to the weather test as described above:

| | No of units having dew points | | | | | | |
|---|---|---|---|---|---|---|---|
| No of cycles | <−50° C. | −49° C. to −40° C. | −39° C. to −30° C. | −29° C. to −20° C. | −19° C. to −10° C. | −9° C. to −1° C. | >0° C. |
| 59 | 10 | | | | | | |
| 110 | 8 | 1 | 1 | | | | |
| 159 | 6 | 2 | 1 | | | | 1 |
| 211 | 5 | 3 | 1 | | | | 1 |
| 256 | 5 | 2 | 1 | | | 1 | 1 |
| 309 | 5 | 2 | | 1 | | | 2 |
| 357 | 5 | 1 | | 1 | | 1 | 2 |
| 403 | 5 | 1 | | | 1 | | 3 |
| 480 | 3 | 2 | | | 1 | | 4 |
| 528 | 3 | 1 | | 1 | | 1 | 4 |
| 575 | 1 | 2 | | 1 | | | 6 |

The results show a steady failure of the units on test until, after 575 cycles, 60% of the units had failed completely. This contrasts sharply with Example 1 (in accordance with invention) in which 100% of the units had maintained a dew point below −50° C. after 1000 cycles.

The thickness measurements showed the same surprising changes in thickness (which were indeed slightly more pronounced) as the weathering tests were carried out.

EXAMPLE 2

The procedure of Example 1 was reseated using PRC (trade mark) 469 two part polysulphide as secondary sealant in place of the Dow Corning silicone sealant. As in Example 1, all 10 units maintained a dew point below −50° C. for over 700 cycles. After 728 cycles, one unit was dropped and removed from test. After 868 cycles, the dew point of one unit had risen to a temperature in the range −49° C. to −40° C., the dew point of this unit increased to above 0° C. (unit failure) after 1004 cycles, with the remaining units maintaining dew points below −50° C. to 1004 cycles whereupon testing was terminated.

The thickness measurements showed similar trends to those observed in Example 1, except that the maximum thicknesses were observed somewhat later in the test procedure and the thicknesses increased at the mid points of the edges declined to substantially zero thereafter, with an overall negative increase i.e. a reduction on the original thickness, being observed at the mid points of the long edges after 600 cycles.

COMPARATIVE EXAMPLE 2

The procedure of Comparative Example 1 was repeated using PRC (trade mark) 469 two part polysulphide in place of the Dow Corning silicone sealant. The results of the weather tests are set out below:

| No of cycles | No of units having dew points | | | | | | |
|---|---|---|---|---|---|---|---|
| | <−50° C. | −49° C. to −40° C. | −39° C. to −30° C. | −29° C. to −20° C. | −19° C. to −10° C. | −9° C. to −1° C. | >0° C. |
| 50 | 10 | | | | | | |
| 98 | 10 | | | | | | |
| 146 | 10 | | | | | | |
| 195 | 10 | | | | | | |
| 246 | 8 | 2 | | | | | |
| 293 | 8 | | 1 | | | 1 | |
| 341 | 7 | 1 | | | | | 2 |
| 398 | 7 | | | | | 1 | 2 |
| 451 | 7 | | | | | | 3 |
| 506 | 5 | | 1 | 1 | | | 3 |
| 555 | 4 | 1 | | | | 2 | 3 |
| 606 | 3 | 1 | | 1 | | | 5 |
| 650 | 2 | 1 | | 1 | | | 6 |
| 728 | 2 | | | | | | 8 |
| 776 | 2 | | | | | | 8 |
| 825 | 2 | | | | | | 8 |
| 868 | 2 | | | | | | 8 |
| 916 | 2 | | | | | | 8 |
| 1004 | 2 | | | | | | 8 |

This result, with only 20% of the units surviving to 1000 cycles, contrasts sharply with result of Example 2 in which 80% of the units maintained a dew point below −50° C. after over 1000 cycles (and one of the remaining 2 units failed because it was dropped).

The thickness measurements showed the same trend as in Example 2.

EXAMPLE 3

The procedure of Example 2 was repeated using PRC (trade mark) 449 two part polysulphide as secondary sealant in place of the PRC 469 used in Example 2; the PRC 449 has a higher modulus than PRC 469. All 10 test units maintained a dew point below −50° C. or over 1000 cycles, when testing was terminated.

The thickness measurements again showed a geneses increase in thickness. Initially, this was greatest at the aid points of the long edges (around 1 mm after 150 cycles) and least at the mid points of the short edges (around 0.5 mm after 150 cycles) with an intermediate value at the corners. However, as the testing continued, the thickness increased to over 1 mm at the corners after approximately 800 cycles, with smaller, substantially equal, increases at the mid points of the long and short edges.

COMPARATIVE EXAMPLE 3

The procedure of Comparative Example 2 was repeated using PRC (trade mark) 449 too part polysulphide in place of the PRC 469 in Comparative Example 2. The results of the weather tests are set out below:

| No of cycles | No of units having dew points | | | | | | |
|---|---|---|---|---|---|---|---|
| | <−50° C. | −49° C. to −40° C. | −39° C. to −30° C. | −29° C. to −20° C. | −19° C. to −10° C. | −9° C. to −1° C. | >0° C. |
| 50 | 9 | | | | | | 1 |
| 98 | 9 | | | | | | 1 |
| 146 | 9 | | | | | | 1 |
| 195 | 9 | | | | | | 1 |
| 246 | 9 | | | | | | 1 |
| 293 | 8 | | | | | | 1 |

-continued

| No of cycles | No of units having dew points | | | | | | |
|---|---|---|---|---|---|---|---|
| | <−50° C. | −49° C. to −40° C. | −39° C. to −30° C. | −29° C. to −20° C. | −19° C. to −10° C. | −9° C. to −1° C. | >0° C. |
| 341 | 9 | | | | | | 1 |
| 398 | 9 | | | | | | 1 |
| 451 | 9 | | | | | | 1 |
| 506 | 8 | 1 | | | | | 1 |
| 555 | 8 | | 1 | | | | 1 |
| 606 | 8 | | | 1 | | | 1 |
| 650 | 8 | | | | | 1 | 1 |
| 728 | 6 | 1 | 1 | | | | 2 |
| 776 | 5 | 1 | 1 | | | 1 | 2 |
| 825 | 4 | 2 | | | | 1 | 3 |
| 868 | 3 | 3 | | | | | 4 |
| 916 | 2 | 1 | 2 | 1 | | | 4 |
| 965 | 1 | 2 | 1 | 2 | | | 4 |
| 1004 | | 1 | 1 | | 1 | | 7 |

One unit vented early in the test procedure; the reason for this was not known, but it may have been due to a flaw in the glass edge. The results contrast sharply with those of Example 3, with 7 units (including the one that had vented) having failed after 1004 cycles, and no units maintaining a dew point below −50° C. to this stage when the tests were terminated. Comparing the results after 650 cycles of Comparative Examples 2 and 3 it appears that, in the absence of the thick primary seal in accordance with the invention, the higher modulus PRC 449 gives a better performance than the lower modulus PRC 469. However, it is notable that, using the higher modulus material (without the thick primary seal), two units had maintained a dew point below −50° C. for over 1000 cycles, whereas no units using the lower modulus material maintained this dew point beyond 1000 cycles. In any event, it is clear that the choice of a particular secondary sealant is relatively unimportant provided a thick primary seal in accordance with the invention is used.

The thickness measurements again showed an increase in thickness all around the unit, although this was less pronounced than in Example 3.

ADDITIONAL EXAMPLES

Further test samples in accordance with the invention using coated glasses (i.e. glasses with an infra-red reflecting fluorine doped tin oxide coating) and rolled patterned glasses have been tested to over 500 cycles with excellent results.

What is claimed is:

1. A sealed insulation unit comprising two parallel opposed panes with a spacing and sealing system therebetween, the spacing and sealing system and panes defining a sealed gas spaced, said spacing and sealing system comprising:

a spacer frame comprising an elongate hollow metal member having opposed outer and inner walls connected together by two opposed sides walls, the side walls each defining therein an elongate recess having a section in the form of a trapezium, a primary seal interposed between each side wall of the spacer frame and the opposing pane, and a secondary seal extending between the panes outside the outer peripheral face of the spacer frame, wherein each primary seal is greater than 0.4 mm thick on construction of the unit and comprises at least 7 grams of sealant material on each side of the spacer frame per meter of the spacer frame length.

2. A sealed insulating unit according to claim 1 wherein the trapezium is a regular trapezium.

3. A sealed insulating unit according to claim 2 wherein the trapezium is defined between two inclined wall parts and a central straight wall part having a length shorter than the open side of the recess.

4. A sealed insulating unit according to claim 3 wherein the inclined wall parts are each inclined to the straight wall part at an angle of around 110°.

5. A sealed insulating unit according to claim 4, further comprising in each side wall a laterally outwardly inclined wall connecting between the outer wall and one of the inclined wall parts.

6. A sealed insulating unit according to claim 1 wherein the recess is around 1.5 mm wide.

7. A sealed insulating unit according to claim 1 wherein each recess is located between two side wall edge faces which are substantially laterally level.

8. A spacer for a sealed insulating unit comprising two parallel opposed panes with a spacing and sealing system therebetween, the spacer comprising an elongate hollow metal member having opposed outer and inner walls connected together by two opposed side walls, the side walls each defining therein an elongate recess having a section in the form of a trapezium, the dimensions of the recess being selected so that sufficient primary sealant can be accommodated therein to provide in the sealed insulating unit opposed primary seals each at least 0.4 mm thick.

9. A spacer according to claim 8 wherein the trapezium is a regular trapezium.

10. A spacer according to claim 8 wherein the trapezium is defined between two inclined wall parts and a central straight wall part having a length shorter than the open side of the recess.

11. A spacer according to claim 10 wherein the inclined wall parts are each equally inclined to the straight wall part.

12. A spacer according to claim 11 wherein the inclined wall parts are each inclined to the straight wall part at an angle of around 110°.

13. A spacer according to claim 10 further comprising in each side wall a laterally outwardly inclined wall connecting between the outer wall and one of the inclined wall parts.

14. A spacer according to claim 8 wherein the recess is around 1.5 mm wide.

* * * * *

UNITED STATES PATENT AND TRADEMARK OFFICE

CERTIFICATE OF CORRECTION

PATENT NO. : 5,819,499

DATED : October 13, 1998

INVENTOR(S) : Evason, et al.

It is certified that error appears in the above-identified patent and that said Letters Patent is hereby corrected as shown below:

On the title Page:

add item [73] Assignee: Pilkington Glass Limited, Merseyside, United Kingdom--.

Signed and Sealed this

Fourteenth Day of September, 1999

*Attest:*

Q. TODD DICKINSON

*Attesting Officer*

*Acting Commissioner of Patents and Trademarks*